United States Patent [19]

Mürtz

[11] Patent Number: 4,577,651

[45] Date of Patent: Mar. 25, 1986

[54] DEVICE FOR CLEANING CONTAINERS

[76] Inventor: Robert Mürtz, Neuwiederstrasse 12, 5470 Andernach 12, Fed. Rep. of Germany

[21] Appl. No.: 601,800

[22] Filed: Apr. 19, 1984

[30] Foreign Application Priority Data

Apr. 28, 1983 [DE] Fed. Rep. of Germany ..... 3315413

[51] Int. Cl.[4] ..... B08B 3/02

[52] U.S. Cl. ..... 134/111; 134/132; 134/133; 134/140; 134/145; 134/153; 134/159; 134/165; 198/724

[58] Field of Search ..... 134/66–68, 134/70, 77, 78, 82–86, 88, 92, 104, 110, 111, 124, 125, 127, 128, 132, 133, 138, 148, 142–146, 152, 153, 157, 65, 140, 158, 159, 165; 198/417, 491, 724, 778

[56] References Cited

U.S. PATENT DOCUMENTS

| | | | |
|---|---|---|---|
| 978,623 | 12/1910 | Nader | 134/145 X |
| 1,022,196 | 4/1912 | Kiefer | 134/145 |
| 1,046,062 | 12/1912 | Felt | 134/132 |
| 1,906,548 | 5/1933 | Davis | 134/145 X |
| 2,717,608 | 9/1955 | Baldwin | 134/142 X |
| 2,777,567 | 1/1957 | Russell | 198/724 X |
| 3,295,666 | 1/1967 | Kay et al. | 198/724 |
| 4,108,774 | 8/1978 | Babunovic et al. | 134/104 X |
| 4,114,752 | 9/1978 | Schiek | 198/491 |
| 4,329,184 | 5/1982 | Hanson | 134/68 X |
| 4,479,574 | 10/1984 | Julius et al. | 134/125 X |

FOREIGN PATENT DOCUMENTS

| | | | |
|---|---|---|---|
| 598020 | 5/1934 | Fed. Rep. of Germany | 134/145 |
| 2901027 | 7/1980 | Fed. Rep. of Germany | 134/65 |
| 334776 | 9/1930 | United Kingdom | 134/159 |
| 822923 | 11/1959 | United Kingdom | 134/145 |
| 659211 | 4/1979 | U.S.S.R. | 134/83 |

*Primary Examiner*—Philip R. Coe

*Attorney, Agent, or Firm*—Max Fogiel

[57] ABSTRACT

A device for cleaning containers, especially bottle containers. To make it more compact while ensuring thorough cleaning it is characterized by a container intake (2), by a subsequent helical guide (6) for the containers (1), by at least one container carrier (5) positioned within the helical guide with integrated spray nozzles (16) for the cleaning agent, and by a container outtake (8) downstream of the helical guide.

8 Claims, 7 Drawing Figures

DEVICE FOR CLEANING CONTAINERS

Figure 1:
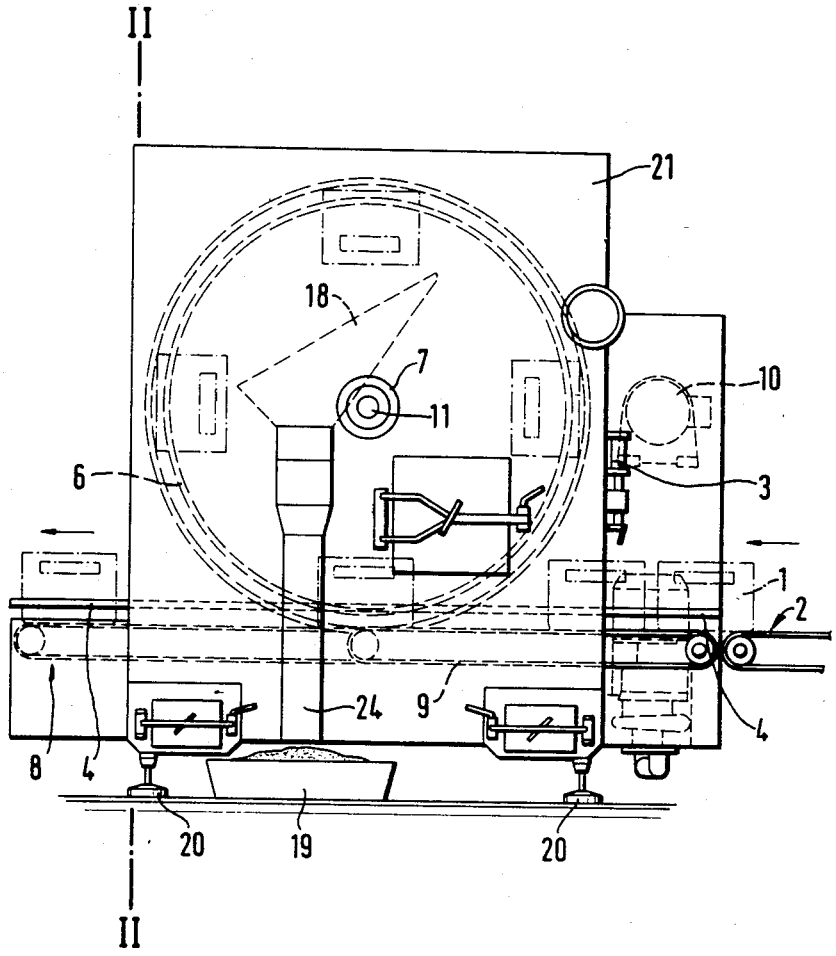

The invention concerns a device for cleaning containers, especially bottle containers.

The drawback to bottle containers, in particular those made out of plastic and in which a large number of bottles, 25, 15, or more for example, are kept separate by usually intersecting partitions to avoid mutual damage, is that the intersecting partitions readily pick up materials that contaminate the overall container and make it difficult or even impossible to refill the container with bottles. Not only labels, advertising fliers, receipts, etc. but also other materials found by chance or by necessity at the site where the bottles in the container are being stored or sold can get into the compartments. The bottle containers are usually washed by personnel assigned for the purpose before the bottles are placed in the containers. Manual cleaning, however, often means that filling the bottles themselves or other preparatory operations must be interrupted as well as being cost intensive because of the extra labor that must be hired.

To eliminate these drawbacks a container-rotating device that rotates the bottle containers automatically and without manual involvement, thus facilitating their cleaning, is known from German Offenlegungsschrift No. 2 901 027. This makes it possible to augment the cleansing action with a stream of gas, compressed air or carbon dioxide for instance, or of liquid cleaning agent, water or a detergent solution for instance. The known container-rotating device is distinguished by conveyor mechanisms, carriers mounted in such a way that they can rotate in a holder, a radial cam that helps the carriers hold the bottle containers securely, chain wheels that are connected to the carriers, that engage with teeth, and that are positioned in such a way that the chain wheels, carriers, and containers are rotated around a partial angle when the teeth are engaged, antirotation mechanisms that prevent undesired rotation of the carriers and containers, and teeth and, if necessary, additional teeth that rotate the carriers and containers around another partial angle. A container-rotating device of this type necessitates considerable space in relation to the conveyor mechanism, and the requisite radial cam, teeth, and anti-rotation mechanisms for the carriers complicate its design, necessarily involving malfunctions during operation.

The object of the present invention is to provide a device for cleaning containers, especially bottle containers, that, at a given capacity for thoroughly cleaning the containers, will simultaneously be extremely compact and as simple as possible in design.

This object is attained in a device characterized by a container intake, by a subsequent helical guide for the containers, by at least one container carrier positioned within the helical guide with integrated spray nozzles for the cleaning agent, and by a container outtake downstream of the helical guide.

To ensure rapid feed and removal of the containers, both the container intake and the container outtake in one embodiment of the invention are continuously operating conveyors in the form of continuous belts or of rollers.

The input of the container intake in this embodiment has in a practical way a pneumatically controlled stop that synchronizes the operations. The stop can have a light barrier, for instance, to monitor the containers. If no container is present, the device will remain in the ready state until a container is at the stop and the light barrier is blocked. The light barrier will then activate the device and retract the stop.

Another embodiment of the invention has additional stationary cleaning-agent spray nozzles outside of the helical container guide and aimed inward. This system cleans the containers even more thoroughly.

In one development of the object of the invention the helical guide for the containers consists of four parallel helical tubes, with the two outer helical tubes, which position the side walls of the containers, are higher than the two inner helical tubes, which support the bottom of the containers.

A helical guide of this type preferably has two coils, meaning that the containers will be rotated a full 360° twice in order to clean them more thoroughly, and operates with no moving parts, which almost entirely eliminates malfunctions.

To accommodate the helical guide to containers of various widths and to secure them in a practical way inside the device, the individual helical pipes that constitute the container guide in another embodiment of the object of the invention are fastened to holders that extend transversely through the device's housing and the interval between the outer helical tubes can be varied by shifting one of the tubes.

The container carrier in one preferred embodiment of the device consists of four parallel rods that extend across the helical container guide and are attached by a fork to a driveshaft centrally mounted inside the helical guide, with the two outer rods, which position the side walls of the containers, are higher than the two inner rods, which support the top of the containers.

To ensure perfect accommodation and release of the containers by the carriers in this embodiment, the carrier rod facing the front of the containers is shorter to an extent that equals the width of the helical container guide in the vicinity of the container intake and the carrier rod facing the rear of the containers is shorter in the vicinity of the container outtake to an extent that equals the width of the helical container guide.

To adapt the device in accordance with the invention to containers of various heights, the length of the driveshaft of the carrier-fork connecting arm in another embodiment of the invention is adjustable.

To allow the device in accordance with the invention to handle several containers at one time, it preferably contains a series of four container carriers arrayed in the form of a cross.

In another preferred embodiment of the device in accordance with the invention a pipeline equipped with spray nozzles is associated with each container-carrier rod and the pipelins are supplied with cleaning agent through the driveshaft, which is hollow, and through the carrier forks, which are also hollow. The direct association of the spray nozzles with the container carriers means that the containers can, because of their slow lateral progression, be conveyed slowly past the spray nozzles, which allows them to be more thoroughly cleaned.

To allow recirculation of the cleaning agent, water or a detergent solution for instance, the driveshaft in another embodiment of the invention communicates through a pipe connection with a high-pressure pump that recirculates the cleaning agent back to the spray nozzles through a filter.

To allow the device to be operated continuously, the container intake, the container outtake, and the shaft that drives the container carriers can be powered with chains in synchronization by a geared motor.

In another preferred embodiment of the invention a funnel that communicates with a trash receptacle is associated with the first coil of the helical container guide downstream of the container intake in such a way that any solid materials in the containers will drop into the funnel when the containers are rotated about 120° to 200°. This facilitates cleaning the device in accordance with the invention.

Figure 2:
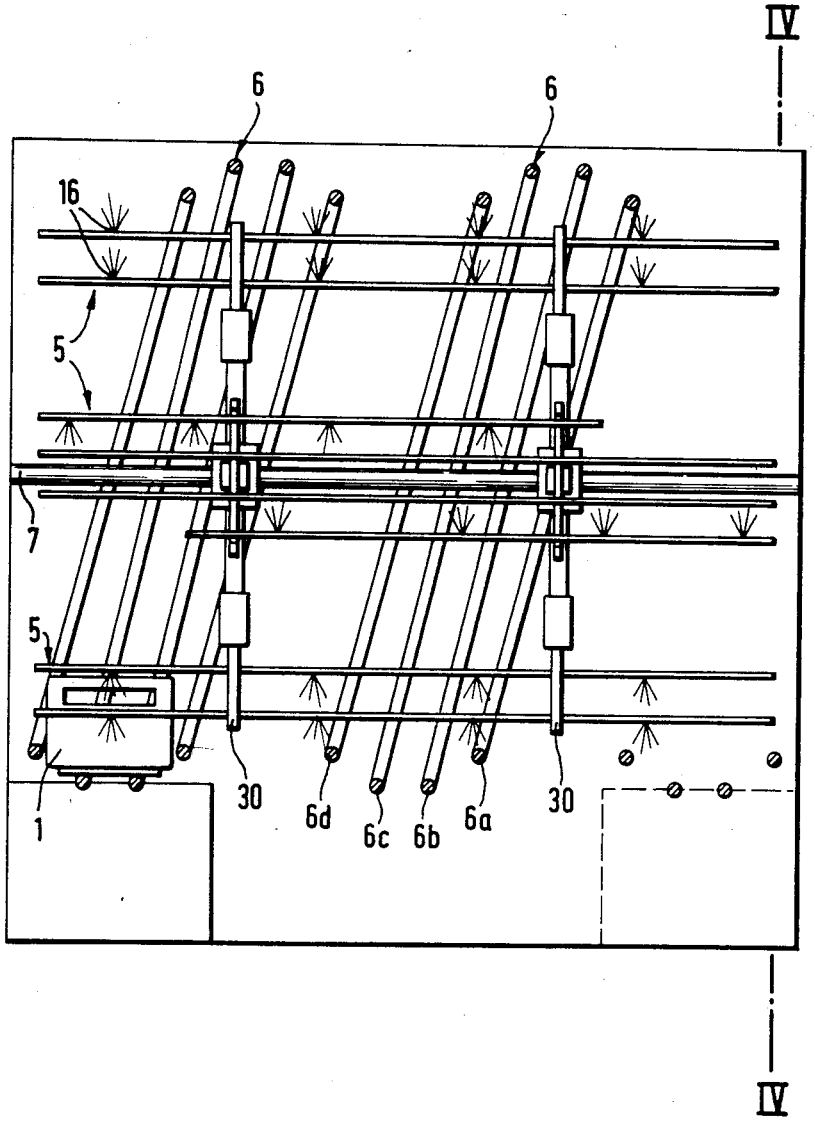
Figure 3:
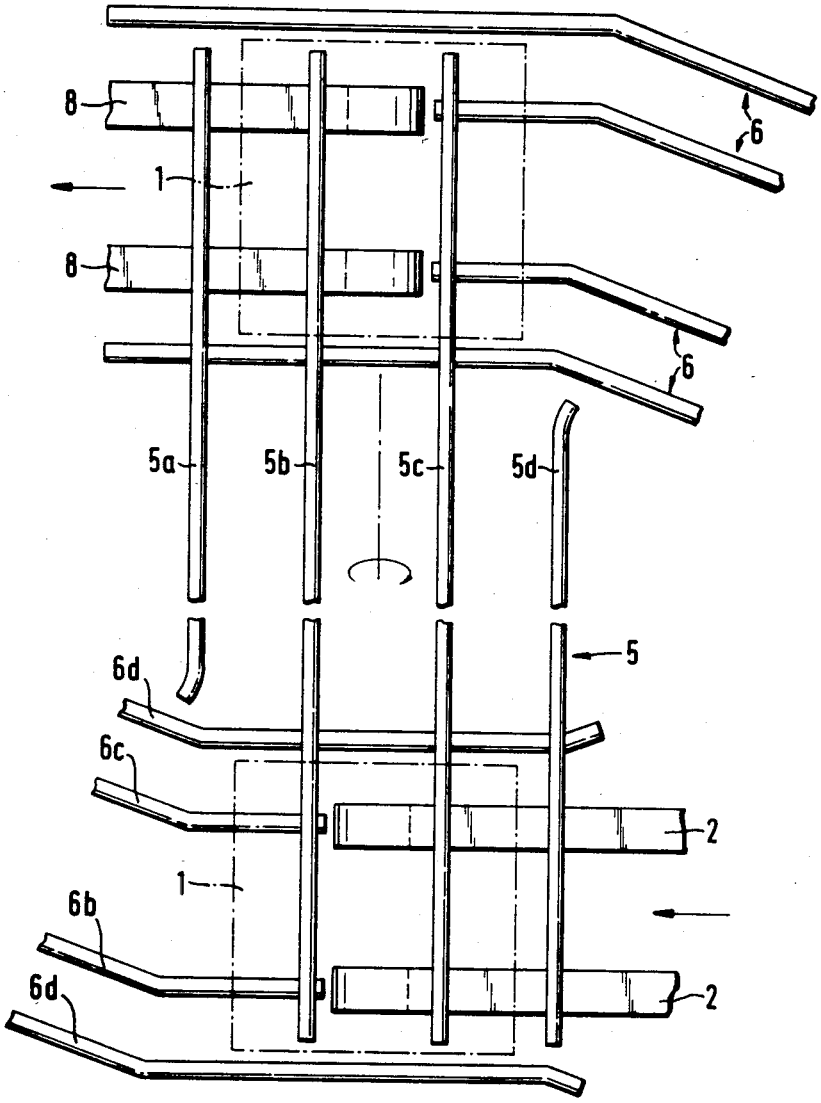
Figure 4:
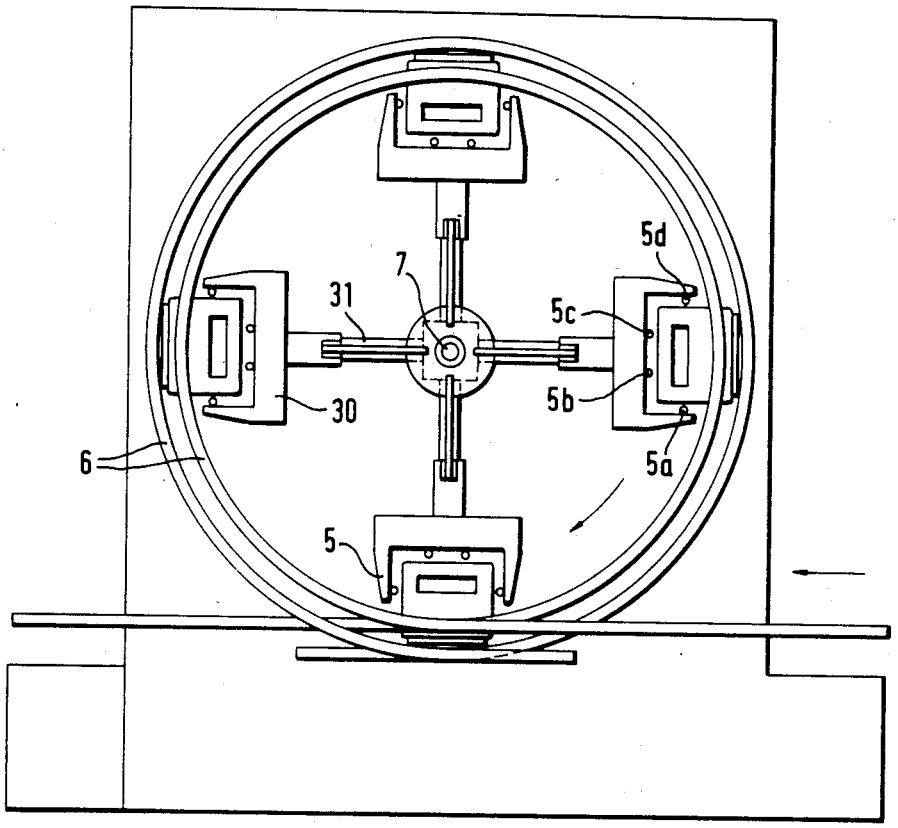
Figure 5:
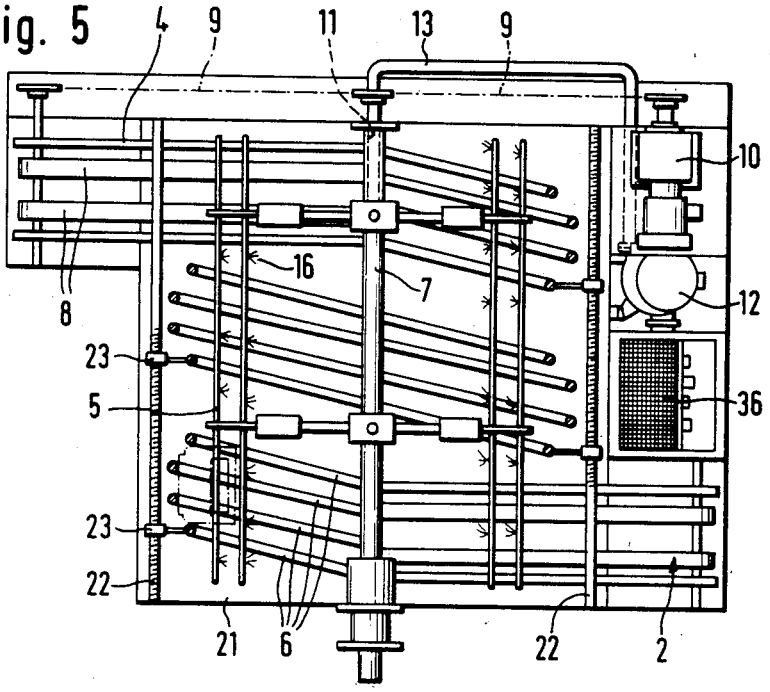
Figure 6:
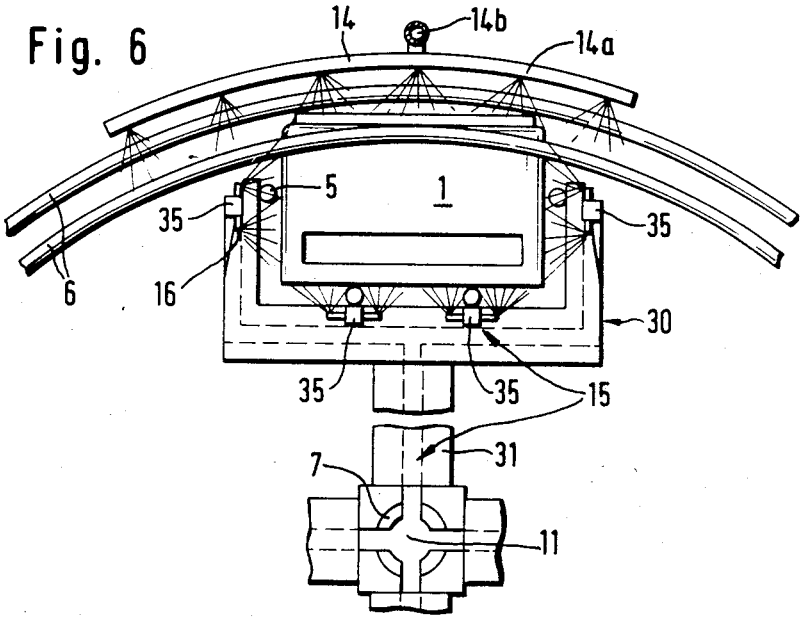
Figure 7:
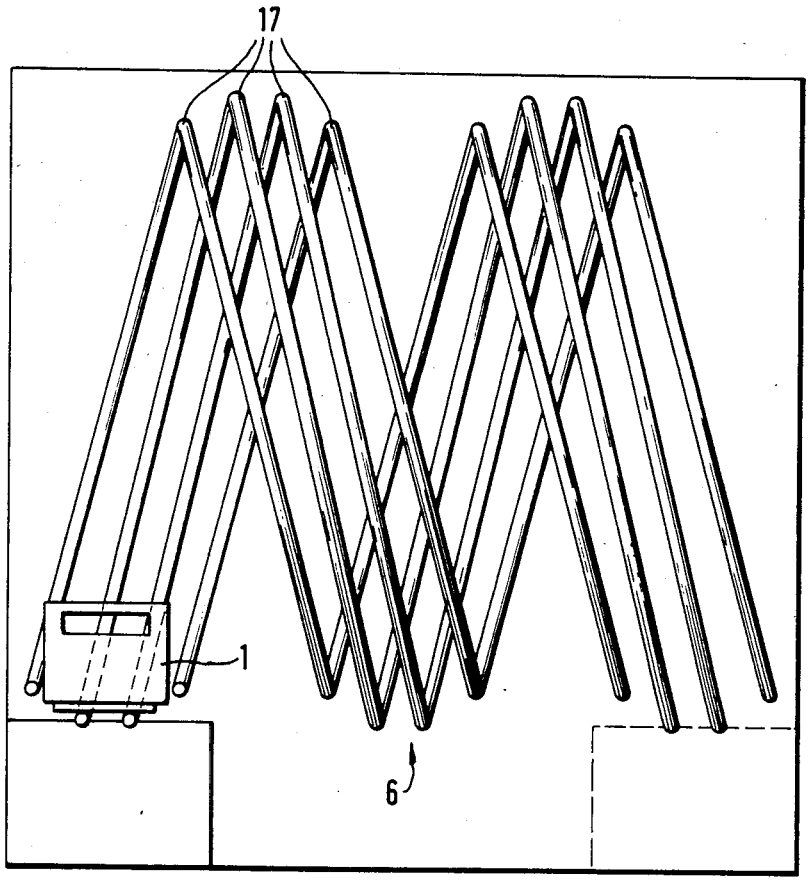

The theory behind the invention will now be described in detail with reference to the drawings, in which FIG. 1 is a front elevation of the device in accordance with the invention, FIG. 2 is a section along the line II—II in FIG. 1, FIG. 3 is an elevational view of a portion of the container carrier in FIG. 2 in a larger scale, and shows the carrier and helical guide, FIG. 4 is a section along the line IV—IV in FIG. 2, FIG. 5 is a plan of the device illustrated in FIG. 1, FIG. 6 is a plan view on an enlarged scale of a portion of the container carrier shown in FIG. 5, and FIG. 7 is a perspective elevational view of an individual container guide shown in FIG. 2.

The device has a housing 21 that rests on feet 20 and has a container intake 2 on one side and a container outtake 8 on the other. The containers 1 are positioned in container intake 2 and in container outtake 8 by means of side rails 4. Both container intake 2 and container outtake 8 are continuous belt conveyors. The input container intake 2 has a pneumatically controlled stop that synchronizes the operations. Subsequent to container intake 2 is a helical guide 6 for containers 1 with two complete coils 17 and merges into container outtake 8. Helical guide 6 consists of four parallel helical tubes 6*a* through 6*d*. The two outer helical tubes 6*a* and 6*d*, which are on the same level, are higher than the two inner helical tubes 6*b* and 6*c*, which are also on one level. Outer helical tubes 6*a* and 6*d* position the lateral walls of containers 1 and inner helical tubes 6*b* and 6*c* position the bottom of containers 1. Holders 22 extend traversely through housing 21 and support the individual helical tubes 6*a* through 6*d*. In order to clean containers of various widths in the device, the distance between outer helical tube 6*a* and outer helical tube 6*d* can be varied by means of an internally-thread gear on holders 22.

Inside the helical guide 6 for containers 1 are four container carriers 5 arrayed in the form of a cross and attached through appropriate forks 30 to associated connecting arms 31 on a driveshaft 7 mounted centrally to helical guide 6 inside housing 21. Driveshaft 7, container intake 2, and container outtake 8 are connected to a geared motor 10 by chains 9, synchronizing the operations of these components. Each container carrier 5 consists of four parallel rods 5*a* through 5*d* that extend across the helical guide 6 for containers 1. Rods 5*a* through 5*d* are fastened to the inside of each associated fork 30 in such a way that the two outer rods 5*a* and 5*d* position the side walls of containers 1 and the two inner rods 5*b* and 5*c* position the top of containers 1 as they are being conveyed through the device. To ensure perfect accommodation of the containers by carriers 5, the carrier rod 5*a* facing the front of the containers is shorter to an extent that equals the width of helical container guide 6 in the vicinity of the container intake 2. To ensure perfect release of the containers by carriers 5, the carrier rod facing the rear of the containers is shorter in the vicinity of container outtake 8 to an extent that equals the width of the helical container guide.

A pipeline 35 equipped with spray nozzles 16 is associated with each container-carrier rod 5*a* through 5*d*. The individual spray nozzles 16 are aimed at containers 1 as they travel by in container carriers 5. Pipelines 35 are supplied with cleaning agent through driveshaft 7, which is hollow, through forks 30, which are also hollow, and through their associated hollow connecting arms 31. The bore 11 in driveshaft 7 communicates with a high-pressure pump 12 through a pipe connection 13. High-pressure pump 12 recirculates the cleaning agent back to spray nozzles 16 through a filter 36, ensuring constant circulation of the cleaning agent. High-pressure pump 12 also communicates in the vicinity of its connection to rotating spray system 15 with a stationary spray system 14 outside of helical guide 6. Stationary spray system 14, which has spray nozzles 14*a* and a connecting line 14*b* leading to high-pressure pump 12, can extend partly or entirely around the circumference of helical guide 6 for containers 1, contributing to their more thorough cleaning.

A funnel 18 is associated with the first coil of helical container guide 6 downstream of container intake 2 in such a way that any solid materials in the containers will drop into the funnel when the containers are rotated about 120° to 200°. Funnel 18 empties into a downpipe 24, through which the solid materials arrive in a trash receptacle 19 below housing 21.

The operation of the device will now be described.

When the device is activated, containers 1 pass separately and synchronized by pneumatic stop 3 along with container carriers 5 into the device through container intake 2. The containers are then taken one after the other by rotating container carriers 5 and conveyed in vertical spirals through helical guide 6. During their whole trip through helical guide 6, the containers are sprayed with cleaning agent from rotating spray system 15 and from stationary spray system 14. The spray nozzles 16 in rotating spray system 15 in particular ensure that the containers will be thoroughly sprayed as they travel over the total spiral path along the separate coils of helical guide 6 with a relatively slow lateral motion, passing by the nozzles, and accordingly thorough cleaned. When the containers are initially positioned at an angle of approximately 120° to 200° as the travel along their spiral path through helical guide 6, any solid materials in the containers will drop through funnel 18 into trash receptacle 19. Once the containers have been advanced through coils 17 of helical guide 6 by container carriers 5 and simultaneously cleaned, they are conveyed out of the device as soon as they arrive at the bottom point at container outtake 8. Since container intake 2, container outtake 8, and driveshaft 7 are all synchronized, the overall container-cleaning device can operate on a constant basis.

Although the device has been described with reference to only one embodiment, many variations that fall within the scope of the invention will be obvious to one skilled in the art.

I claim:

1. Apparatus for cleaning bottle-shaped containers, comprising: container intake means; helical guide means located in a path after said intake means for guiding said containers along a path of travel; at least one container carrier positioned within said helical guide means and having integrated spray nozzles for cleaning agent; and container outtake means downstream of said helical guide means, said container carrier being rotatable and extending transverse through the inside of said helical guide means, said container carrier being free of separate container receptacles; an input of said container intake means having a pneumatically controlled stop for synchronizing operations; stationary cleaning-agent spray nozzles outside of said helical guide means and aimed inward; said helical guide means comprising four parallel helical tubes with two outer helical tubes positioning side walls of the containers, said two outer helical tubes being higher than two inner helical tubes supporting bottoms of the containers.

2. Apparatus as defined in claim 1, wherein said container intake means and said container outtake means are continuously operating conveyors comprised of continuous belts.

3. Apparatus as defined in claim 1, wherein said helical guide means has two coils.

4. Apparatus as defined in claim 1, wherein said container intake means and said container outtake means are continuously operating conveyors comprised of continuous rollers.

5. Apparatus for cleaning bottle-shaped containers, comprising: container intake means; helical guide means located in a path after said intake means for guiding said containers along a path of travel; at least one container carrier positioned within said helical guide means and having integrated spray nozzles for cleaning agent; and container outtake means downstream of said helical guide means, said container carrier being rotatable and extending transverse through the inside of said helical guide means, said container carrier being free of separate container receptacles; said helical guide means comprising individual helical tubes fastened to holders extending transversely through a housing; spacing between outer helical tubes being variable by shifting one of said tubes; said container carrier comprising four parallel rods extending across said helical guide means; a driveshaft centrally mounted inside said helical guide means; fork means for attaching said parallel rods to said drive shaft; two outer rods positioning side walls of the containers and being higher than two inner rods, said inner rods supporting tops of the containers; said carrier having a carrier rod facing front sides of the containers and being shorter by an amount that equals the width of said helical guide means in vicinity of said container intake means; said carrier having a further carrier rod facing rear sides of the containers and being shorter in vicinity of said container outtake means by an amount that equals the width of said helical guide means.

6. Apparatus as defined in claim 5, wherein said driveshaft has an adjustable length; a series of four container carriers being arrayed in form of a cross; pipeline means having spray nozzles associated with each of said container-carrier rods, said pipeline means supplying cleaning agent through said driveshaft and through the carrier fork means, said drive shaft and fork means being hollow.

7. Apparatus as defined in claim 6, including a high-pressure pump communicating with said drive shaft through a pipe connection, filter means, said high-pressure pump recirculating cleaning agent back to said spray nozzles through said filter means; geared motor means, said container intake means, said container outtake means, and said shaft being powered with chains in synchronization by said geared motor means; funnel means communicating with a trash receptacle and being associated with a coil of said helical guide means downstream of said intake means so that solid materials in the containers will drop into said funnel means when the containers are rotated about 120° to 200°.

8. Apparatus for cleaning bottle-shaped containers, comprising: container intake means; helical guide means located in a path after said intake means for guiding said containers along a path of travel; at least one container carrier positioned within said helical guide means and having integrated spray nozzles for cleaning agent; and container outtake means downstream of said helical guide means, said container carrier being rotatable and extending transverse through the inside of said helical guide means, said container carrier being free of separate container receptacles; said container intake means and said container outtake means comprising continuously operating conveyors; an input of said container intake means having a pneumatically controlled stop for synchronizing operations; stationary cleaning-agent spray nozzles outside of said helical guide means and aimed inward; said helical guide means comprising four parallel helical tubes with two outer helical tubes positioning sidewalls of the containers, said two outer helical tubes being higher than two inner helical tubes supporting bottoms of the containers; said helical guide means having two coils; said helical guide means comprising individual helical tubes fastened to holders extending transversely through a housing; spacing between outer helical tubes being variable by shifting one of said tubes; said container carrier comprising four parallel rods extending across said helical guide means; a drive shaft centrally mounted inside said helical guide means; fork means for attaching said parallel rods to said drive shaft; two outer rods positioning side walls of the containers and being higher than two inner rods, said inner rods supporting tops of the containers; said carrier having a carrier rod facing front sides of the containers and being shorter by an amount that equals the width of said helical guide means in vicinity of said container intake means; said carrier having a further carrier rod facing rear sides of the container and being shorter in vicinity of said container outake means by an amount that equals the width of said helical guide means; said drive shaft having an adjustable length; pipeline means having spray nozzles associated with each of said container-carrier rods, said pipeline means supplying cleaning agent through said drive shaft and through the carrier fork means, said drive shaft and fork means being hollow; funnel means communicating with a trash receptacle and being associated with a coil of said helical guide means downstream of said intake means so that solid materials in the containers will drop into said funnel means when the containers are rotated.

* * * * *